US005222676A

United States Patent [19]

Rebsamen

[11] Patent Number: 5,222,676

[45] Date of Patent: Jun. 29, 1993

[54] PROCESS FOR THE PRODUCTION OF A YARN PACKAGE

[75] Inventor: Arthur Rebsamen, Stallikon, Switzerland

[73] Assignee: Schaerer Schweiter Mettler AG, Horgen, Switzerland

[21] Appl. No.: 784,829

[22] Filed: Oct. 30, 1991

[30] Foreign Application Priority Data

Oct. 30, 1990 [CH] Switzerland ..... 3448/90

[51] Int. Cl.[5] ..... B65H 54/02; B65H 55/04

[52] U.S. Cl. ..... 242/18 R; 242/43 R; 242/43.1; 242/177; 242/178

[58] Field of Search ..... 242/176, 177, 178, 174, 242/175, 159, 43.1, 43 R, 26.1, 26.2, 26.3, 18 R

[56] References Cited

U.S. PATENT DOCUMENTS

| | | | |
|---|---|---|---|
| 1,104,818 | 7/1914 | Mitchell | 242/178 |
| 1,233,041 | 7/1917 | Foster | 242/177 |
| 1,968,406 | 7/1934 | Lambeck | 242/43.1 |
| 2,296,420 | 9/1942 | Campbell | 242/177 |
| 2,848,173 | 8/1958 | Hebberling | 242/43 R |
| 2,858,993 | 11/1958 | Siegenthaler | 242/43.1 |
| 4,055,312 | 10/1977 | Lucke | 242/43.1 |
| 4,789,112 | 12/1988 | Schippers et al. | 242/178 |

FOREIGN PATENT DOCUMENTS

| | | | |
|---|---|---|---|
| 502849 | 3/1939 | United Kingdom | 242/178 |

*Primary Examiner*—Stanley N. Gilreath
*Attorney, Agent, or Firm*—Egli International

[57] ABSTRACT

A yarn build is applied to at a constant traverse length up to a limit diameter D. In order to achieve a uniform yarn draw-off tension, even with packages of large mass and correspondingly large diameter, the traverse length is thereafter reduced as the diameter increases. In the case of a conically shaped tube, the conicity of the build is also reduced which leads to improved exploitation of volume and greater package mass for a given package radius.

20 Claims, 3 Drawing Sheets

PROCESS FOR THE PRODUCTION OF A YARN PACKAGE

BACKGROUND AND OBJECTS OF THE INVENTION

1. Field of the Invention

The present invention relates to a process for producing a yarn package.

2. Description of Related Art

With yarn packages, i.e., bobbins, particularly those which are used for transportation of yarn and from which the yarn is directly unwound for operations such as knitting or weaving, it is desirable for reasons of economy in distribution and further yarn processing, to wind onto each bobbin package as much yarn as possible, i.e. to produce the most massive packages possible.

These efforts come up against a limit in that, with a very large package radius and especially with the use of fine yarn, the yarn draw-off tension at a constant yarn draw-off speed varies across a wide range. The draw-off tension is very high at the start of an unwinding process since, due to the low rotation generated during drawing off, no sufficiently convex yarn balloon is formed. As a result, the yarn scrapes across the surface of the package, thereby producing high friction.

With large radii, especially for fine yarn, the strain is too great and yarn breakages can readily occur. It has been found that even below the breakage threshold large variations in the yarn draw-off tension should be avoided since tension variations in many cases adversely affect the further processing of the yarn and, particularly in the case of knitted and woven products, lead to inhomogeneities.

Therefore, it is an object of the present invention to provide a manufacturing process for yarn packages, by means of which large, massive packages can be produced, from which the yarn can be drawn off at a constant draw-off speed with uniformly moderate yarn tension, thereby reducing yarn breakages and improving the quality and homogenity of final products.

SUMMARY OF THE INVENTION

The above objects and other objects are met by the process of the present invention wherein yarn is wound on a tube at a constant traverse length up to a limit diameter D. Thereafter, the traverse of the yarn is steadily reduced so that the length over which the yarn is laid down is correspondingly shortened. The reduction in the traverse combined with an increasing package diameter leads to an equalization of yarn draw-off tension. As a result, yarn processing is significantly improved and enables yarn to be drawn off in a desirably uniform manner. Furthermore, yarn breakages are reduced and the quality and homogeneity of the products arising out of the further processing are improved and do not suffer from fluctuations in yarn tension.

BRIEF DESCRIPTION OF THE DRAWINGS

The accompanying drawings illustrate principles and preferred embodiments of the present invention, and together with the description, serve to explain the principles of the invention, in which.

DETAILED DESCRIPTION OF PREFERRED EMBODIMENTS

Figure 1:
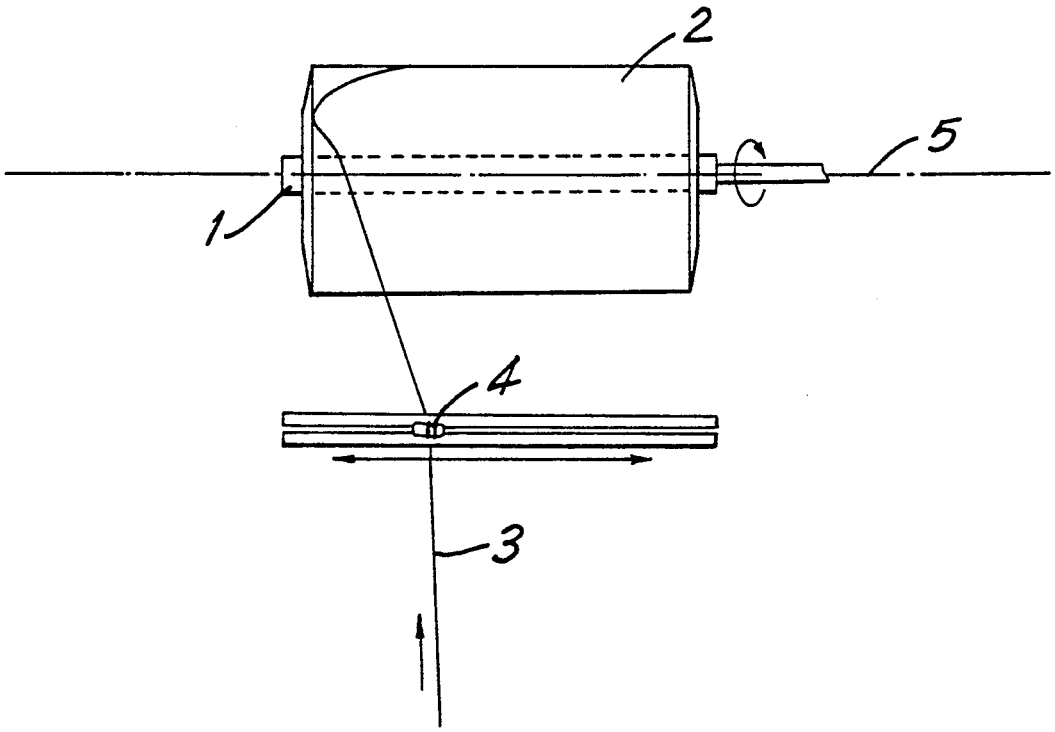
FIG. 1 is a diagrammatic representation of an apparatus for producing a bobbin package.

FIG. 1 shows an apparatus for producing a yarn package. A tube 1, preferably plastic, is rotated as indicated by a drive mechanism and thread 3 is drawn towards the package and wound on it forming a build 2. The thread passes through a yarn-laying unit having a yarn guide 4. The yarn guide is subjected to a reciprocating motion in a direction of the package axis 5 causing the yarn to traverse the tube lengthwise while being wound around same. The rotation of the tube and the motion of the yarn guide can be related in different ways leading to different winding types such as random winding, precision winding, stepped precision winding, and the like. Randeom winding is a term of art connoting a winding process characterized by a constant ratio between the linear velocity of the yarn movement and the yarn traverse cycle speed. In precision winding, the winding spindle and package turn at a uniform number of RPM. Accordingly, the yarn speed increases as the diameter of the package increases, but the number of winds remains constant. Stepped precision winding or DIGICONE® precision winding is well known in the art and is defined in U.S. Pat. No. , 4,515,320.

Figure 2:
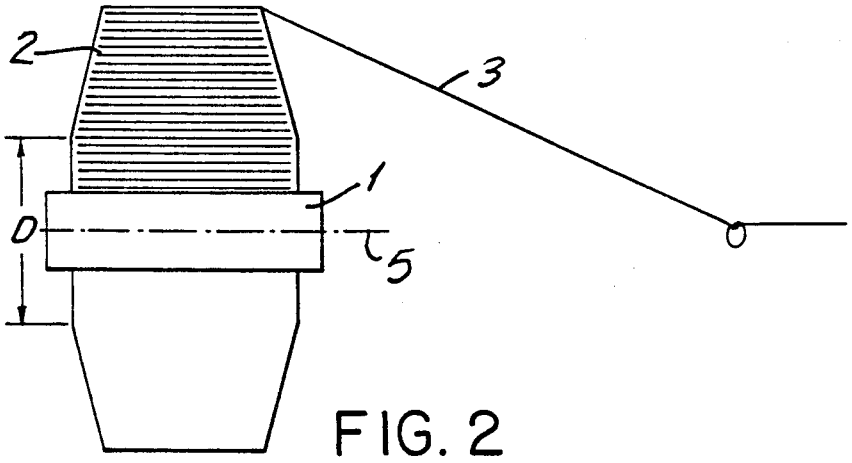
FIG. 2 is a diagrammatic representation of a package produced according to a first embodiment of the process according to the invention, with a cylindrical tube.

FIG. 2 shows a cylindrical tube 1 having a build 2 produced from a chosen yarn. The parallel layers of the build 2 are shown on one side of tube 1. The build 2 exhibits, up to a limit diameter D, a constant traverse length, i.e. it is produced, up to that point, with a constant traverse of the yarn-laying unit.

Once the diameter of the build 2 has reached the limit diameter D, the traverse of the yarn-laying unit is then steadily reduced, so that the length over which the yarn is laid down is correspondingly shortened. The precise control of the traverse can depend upon various parameters which, apart from the diameter, also influence the yarn draw-off tension, such as yarn draw-off speed and yarn fineness. When high requirements are placed upon the uniformity of the yarn draw-off tension, the traverse must be determined so as to take into account the various parameters.

In all cases however, as has been demonstrated by trials, a moderate reduction in traverse combined with an increasing package diameter leads to an equalization of yarn draw-off tension, in particular to its reduction at large diameters, when the yarn 3, as shown, is drawn off overhead in the direction of the package axis 5. Therefore, the yarn package of the present invention, given the requirements in respect of limit value and uniformity of yarn draw-off tension, can be wound to a substantially larger diameter and hence greater mass than achieved by conventional production processes.

Packages produced with the process according to the invention as represented in FIG. 2 are able, for example, given a specified limit value for the fluctuation in draw-off tension and a yarn fineness of Ne 60, to exhibit weights of 2.4–2.6 kg, whereas with a package produced in a known manner with yarn of the same type, designed to satisfy the same requirements, an upper limit of 1.2 kg must not be exceeded.

Since the reduction in traverse at a given package diameter leads to a reduction in package volume, the loss however being substantially less than the gain achieved through the enlargement of the package radius, it is not desirable to reduce the traverse more or earlier than necessary. Since the influence of the package diameter upon the draw-off tension only becomes discernible at higher values, the traverse does not need to be altered until the attainment of the limit diameter D, with the result that the inner part of the build is cylindrical.

Figure 3:
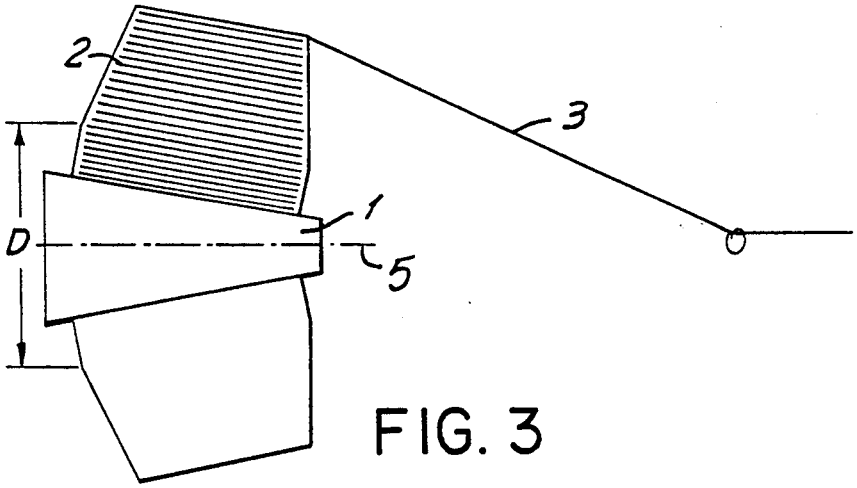
FIG. 3 is a diagrammatic representation of a package produced according to a second embodiment of the process according to the invention, with a conical tube.

In the case of the package represented in FIG. 3, the tube 1 is conically shaped. Here too, the build, for the same reasons as with the embodiment according to FIG. 2, exhibits constant traverse up to a limit diameter D. The layers of the build are concentric, i.e. the conicity of the traverse is constant. Above the limit diameter, the traverse once again starts to decrease as the radius increases, which, as with the first embodiment, leads to an equalization of the yarn draw-off tension or alternatively allows higher package diameters and package masses.

Figure 4:
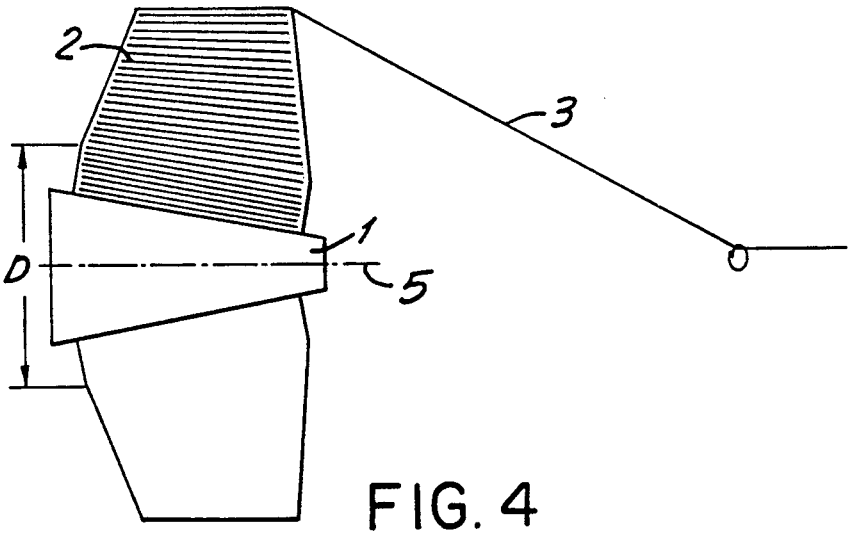
FIG. 4 is a diagrammatic representation of a package produced according to a third embodiment of the process according to the invention, with a conical tube.

FIG. 4 shows a build 2, which is similarly applied on a conical tube 1 and which is also wound, up to the attainment of a limit diameter D, at constant traverse and conicity. Above the limit diameter D, there is a steady decrease not only in the traverse but also in the conicity of the winding, which virtually reaches zero upon the completion of the package. In this way, the volume can be better exploited and a greater package mass achieved for a given package diameter.

With all packages, the build 2, in order to avoid problems in transport and packaging, is applied, through appropriate control of traverse and conicity as a function of the diameter, so that it does not protrude in the axial direction over the ends of the tube 1. With the conical packages, the build 2 can be built up at an approximately constant conicity pre-determined by the tube 1, until it protrudes into the area of the head end of the tube 1, whereupon the traverse or the conicity or both are altered such that their axial extension towards this side no longer increases and preferably remains constant. The imminent reaching of the tube end by the build 2 coincides in this case with the attainment of the limit diameter D.

It has been found that the benefits of the present invention are readily apparent. Three packages or "spools", shown below in Table No. 1, were manufactured and examined. A cylindrical spool coiled using DIGICONE ® precision winding with a conventional production process, a conical spool using DIGICONE ® precision winding with a conventional production process, and an Example A using DIGICONE ® precision winding and the process of the present invention. Example A had a cylindrical diameter up to 160 mm and thereafter shortened in capacity from 152 to 100 mm up until a spool diameter of 270 mm. The spool with random coiling was not examined regarding its running behavior, but rather it was used as a reference for the spool weight.

TABLE NO. 1

| Format | Coiling | Capacity | Diameter | Weight |
|---|---|---|---|---|
| conical | Random Coil | 152 | 183 | 1,305 |
| cylindrical | DIGICONE ® | 152 | 230 | 2,390 |
| conical 4° 20' | DIGICONE ® | 152 | 280 | 3,010 |
| Example A | DIGICONE ® | 152/90 | 270 | 3,075 |

The examination used the Package Performance Analyzer of the company Rieter Scragg in order to examine spools with regard to their running behavior. The Package Performance Factor ("PPF") The PPF is a unique statistical parameter that provides a reliable single figure indication of package unwinding performance. The Package Performance Analyzer is specifically designed to quantify the PPF. Basically, the PPF is a measure of the relationship between high level transient tension excursions and lower level tension variations. The high level transients are caused by snags on the yarn package, and the lower level tension variations are caused by the frictional drag on the yarn caused by the pulling of the yarn over the package and yarn guides. The high level transient tension and lower level tension variations form a random signal that may be affected by any one or combination of factors such as yarn type, package geometry, package density, unwinding speed and balloon length. Accordingly, the PPF can be utilized to optimize any combination of the above listed variables to provide the best package unwinding.

A statistical value is calculated from the continuing measurement of the draw-off tension which characterizes the consistency of the thread removal. Additionally, the analysis determines the mean draw-off tension and the draw-off tension peaks, as well as a frequency distribution of the thread tension during the duration of measurement. Empirical values are used to make assertive comparisons between various spools. For example, this means that the PPF values should remain small and that values greater than 1000 usually lead to thread breaks.

Figure 5A:
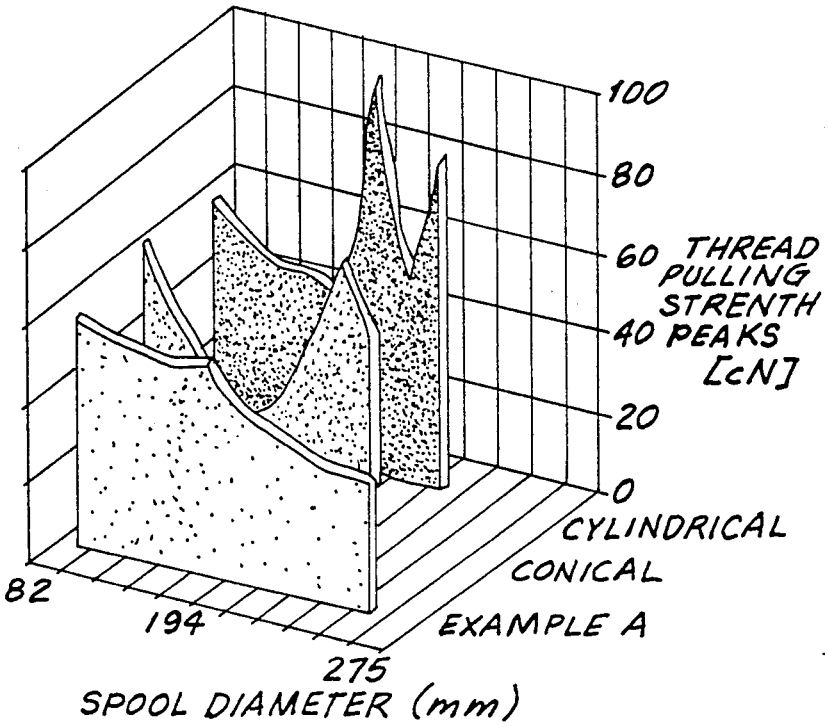
FIG. 5A and 5B are three dimensional graphs of spool diameter verse thread pulling strength peak and Package Performance Factor (PPF), respectively, for three test spools.
Figure 5B:
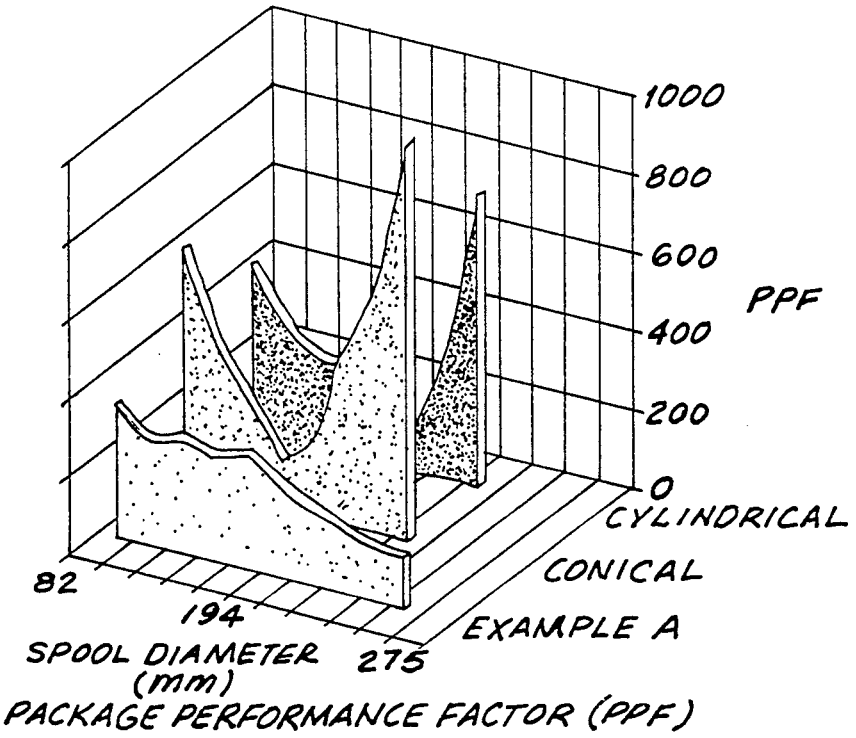

A comparison of the draw-off tension peaks, FIG. 5A, and the PPF values, FIG. 5B, measured over an area of 30 Km indicates that the cylindrical spool ran well up to a diameter of 200 mm. The draw-off tension peaks increase significantly above this diameter. With the conical spool, the draw-off tension peaks with small spool diameters were smaller than with the cylindrical spool, however, they increase for a spool diameter of 200 mm and more, although not as much as with a cylindrical spool. Example A of the present invention indicated very good running features independent of spool diameter. With increasing spool diameters, the draw-off tension peaks even became smaller which is mirrored in he reducing PPF.

The specified process is suitable for combination with all winding principles conventionally found in connection with the production of cross-wound bobbins, such as random winding, precision winding and stepped precision winding, and is particularly useful in the manufacture of packages made of staple yarns.

It will thus be seen that the object set forth above, among those made apparent from the preceeding description, are effectively obtained. Certain changes may be made to the above process without departing from the scope of the present invention, and it is intended that all matter contained in the above description and as shown in the accompanying drawings shall be interpreted as illustrative and not limiting.

I claim:

1. A process for producing a yarn package such that when the yarn is drawn off at a constant yarn draw-off speed, the yarn draw-off tension is approximately constant, said process comprising the steps of:

a) winding yarn around a tube while traversing the yarn across a length of the tube to form a yarn build;

b) maintaining a constant traverse length during the winding until the yarn build reaches a predetermined diameter d; and c) continuously reducing the traverse length when the yarn build reaches the predetermined diameter d for the remainder of the winding.

2. The process according to claim 1, wherein the step of winding comprises winding the yarn on a cylindrical tube.

3. The process according to claim 2, wherein the winding step includes winding the yarn around the tube as a random winding.

4. The process according to claim 2, wherein the winding step includes winding the yarn around the tube as a precision winding.

5. The process according to claim 2, wherein the winding step includes winding the yarn around the tube as a stepped precision winding.

6. The process according to claim 1, wherein the step of winding comprises winding the yarn on a conical tube.

7. The process according to claim 6, wherein the winding step includes winding the yarn around the tube as a random winding.

8. The process according to claim 6, wherein the winding step includes winding the yarn around the tube as a precision winding.

9. The process according to claim 6, wherein the winding step includes winding the yarn around the tube as a stepped precision winding.

10. The process according to claim 6, wherein the step of winding the yarn on a conical tube includes forming the yarn build with a constant conicity below the diameter d and steadily decreasing the conicity of the yarn build above the diameter d.

11. The process according to claim 10, wherein the winding step includes winding the yarn around the tube as a random winding.

12. The process according to claim 10, wherein the winding step includes winding the yarn around the tube as a precision winding.

13. The process according to claim 10, wherein the winding step includes winding the yarn around the tube as a stepped precision winding.

14. The process according to claim 10, wherein the tube has an axial direction, and further including controlling the traverse and conicity of the build as a function of its diameter so that the build, in the axial direction, does not protrude out over the tube.

15. The process according to claim 14, wherein the winding step includes winding the yarn around the tube as a random winding.

16. The process according to claim 14, wherein the winding step includes winding the yarn around the tube as a precision winding.

17. The process according to claim 14, wherein the winding step includes winding the yarn around the tube as a stepped precision winding.

18. The process according to claim 1, wherein the winding step includes winding the yarn around the tube as a random winding.

19. The process according to claim 1, wherein the winding step includes winding the yarn around the tube as a precision winding.

20. The process according to claim 1, wherein the winding step includes winding the yarn around the tube as a stepped precision winding.

* * * * *